US007533782B2

(12) United States Patent
Parker et al.

(10) Patent No.: US 7,533,782 B2
(45) **Date of Patent: *May 19, 2009**

(54) SEALED PROTECTIVE CASE WITH LINER AND LATCH

(75) Inventors: David H. Parker, Torrance, CA (US); John Hoven, Manhattan Beach, CA (US); Kevin Deighton, Long Beach, CA (US)

(73) Assignee: Pelican Products, Inc., Torrance, CA (US)

( * ) Notice: Subject to any disclaimer, the term of this patent is extended or adjusted under 35 U.S.C. 154(b) by 746 days.

This patent is subject to a terminal disclaimer.

(21) Appl. No.: 11/153,076

(22) Filed: Jun. 14, 2005

(65) Prior Publication Data

US 2005/0230395 A1 Oct. 20, 2005

Related U.S. Application Data

(63) Continuation of application No. 10/719,309, filed on Nov. 21, 2003, now Pat. No. 6,953,126, which is a continuation-in-part of application No. 10/001,652, filed on Oct. 31, 2001, now Pat. No. 6,698,608.

(51) Int. Cl.
*B65D 45/22* (2006.01)

(52) U.S. Cl. ..... 220/326; 220/324

(58) Field of Classification Search ..... None
See application file for complete search history.

(56) References Cited

U.S. PATENT DOCUMENTS

| | | | | |
|---|---|---|---|---|
| 2,803,368 | A * | 8/1957 | Koch | 220/4.21 |
| 5,427,265 | A * | 6/1995 | Cautereels et al. | 220/318 |
| 5,472,110 | A * | 12/1995 | Boyd et al. | 220/326 |
| D464,196 | S * | 10/2002 | Parker | D3/273 |
| D465,330 | S * | 11/2002 | Parker | D3/273 |
| 6,953,126 | B2 * | 10/2005 | Parker et al. | 220/4.22 |
| 6,955,381 | B2 * | 10/2005 | Parker et al. | 292/113 |
| D543,700 | S * | 6/2007 | Parker et al. | D3/294 |

* cited by examiner

*Primary Examiner*—Stephen Castellano
(74) *Attorney, Agent, or Firm*—Greenberg Traurig, LLP

(57) ABSTRACT

A protective case which includes two mating case components and a liner extending between a peripheral area for mating engagement to ensure a relatively sealed relationship when the case components are closed. A latch face is a single elongated element on the front and has two spaced interlocking components to cooperate with hooks in the opposite case component.

15 Claims, 3 Drawing Sheets

SEALED PROTECTIVE CASE WITH LINER AND LATCH

RELATED APPLICATIONS

This application is a continuation and claims the benefit or the prior filing date of U.S. application Ser. No. 10/719,309, filed Nov. 21, 2003, now U.S. Pat. No. 6,953,126, which is a continuation-in-part and claims the benefit of the prior filing date of U.S. patent application Ser. No. 10/001,652, filed Oct. 31, 2001 now U.S. Pat. No. 6,698,608, all herein incorporated by reference in their entireties.

BACKGROUND

Field

This invention relates in general to a protective case. In particular, it is concerned with a case which permits for effective shock absorbance to components contained in the case.

Many different carrying cases are known for containing and protecting components. The different cases have different characteristics, each with different limitations. These cases do not have an effective closure and latching characteristics operable in a useful and easy manner, and do not necessarily provide for effectively sealing the container in an easy manner.

The present invention is directed to providing a suitable protective case for securely and sealingly carrying components. The case also permits for relatively straightforward and positive latching with components which are easier to use than latches in known cases. The case seeks to overcome the limitations of known cases.

SUMMARY

According to the invention, there is provided a carrying case which includes a body having two mating components and a peripheral area for mating engagement to ensure a relatively sealed relationship when the components are closed. A liner material conformingly fits in the space formed by the components. The liner material has a conforming fit and preferably provides a sealing component for the peripheral area between the two mating components. The peripheral edge of the liner is arranged for location in the peripheral area between the two mating components.

An elongated latch is provided which extend substantially across about half of the length of the front of the case. The latch includes a face member extending at least about half the length of the front. There are two spaced locking members-for releasably engaging interlocking elements mounted on one of the components, and the latch is hingedly mounted on the other component.

The two elements of the body are mating upper and lower components. Each is made of relatively rigid material, and each has a peripheral formation to engage the mating peripheral formation of the other component. Two spaced hinges are located along the back to permit opening and closure. A handle is located on one of the elements at a side between the front and the back of the case.

A purge valve permits for ingress arid egress of pressure to equilibrate the pressure between the inside and the outside of the body.

The foregoing and other objects, features, and advantages of the present invention will be apparent from the following detailed description of the preferred embodiments which makes reference to several drawing figures.

DRAWINGS

The above-mentioned features and objects of the present disclosure will become more apparent with reference to the following description taken in conjunction with the accompanying drawings wherein like reference numerals denote like elements and in which.

DETAILED DESCRIPTION

Figure 1:
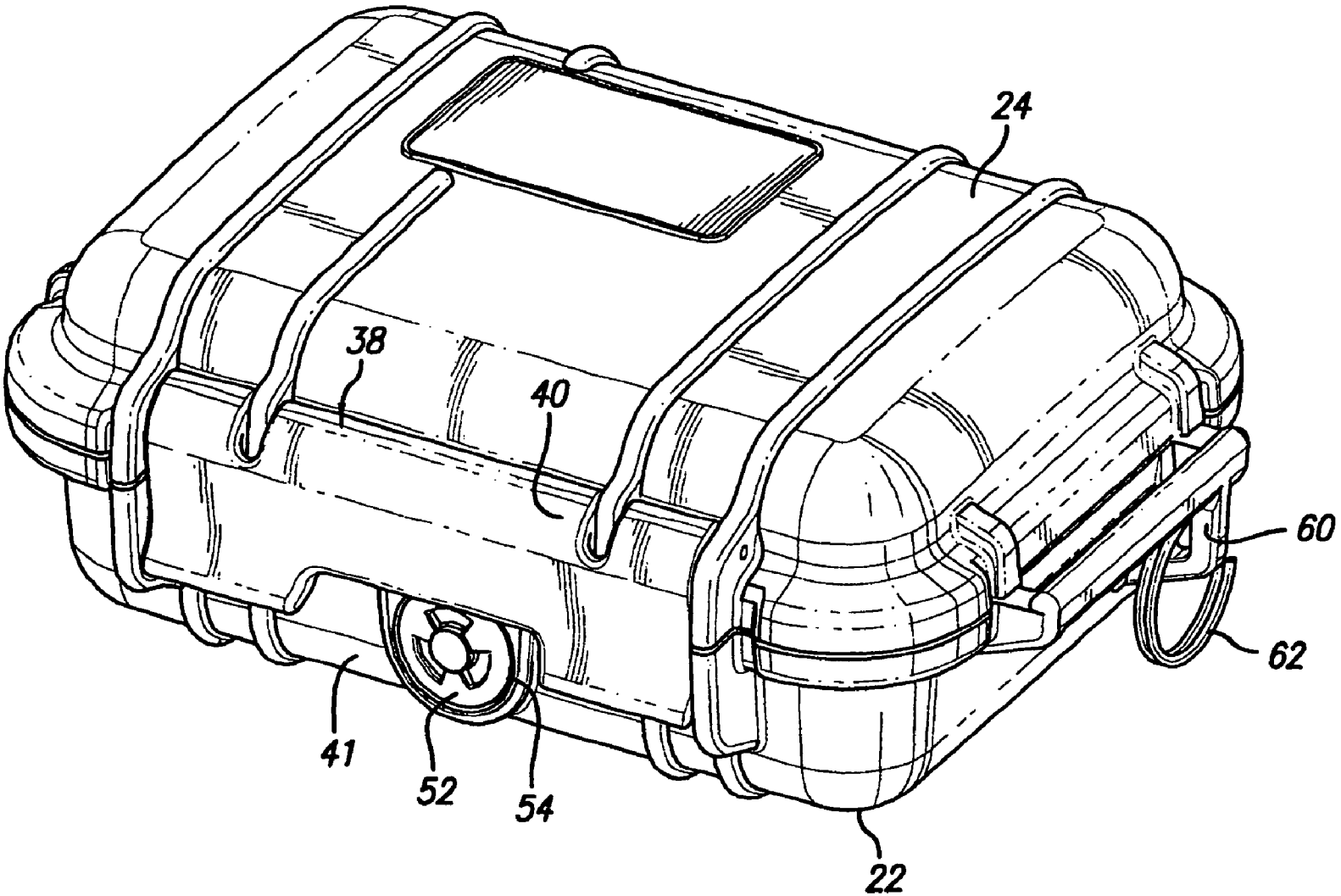
FIG. 1 is a perspective view of one form of a case according to the invention with a base component and a top component shown in closed relationship.
Figure 2:
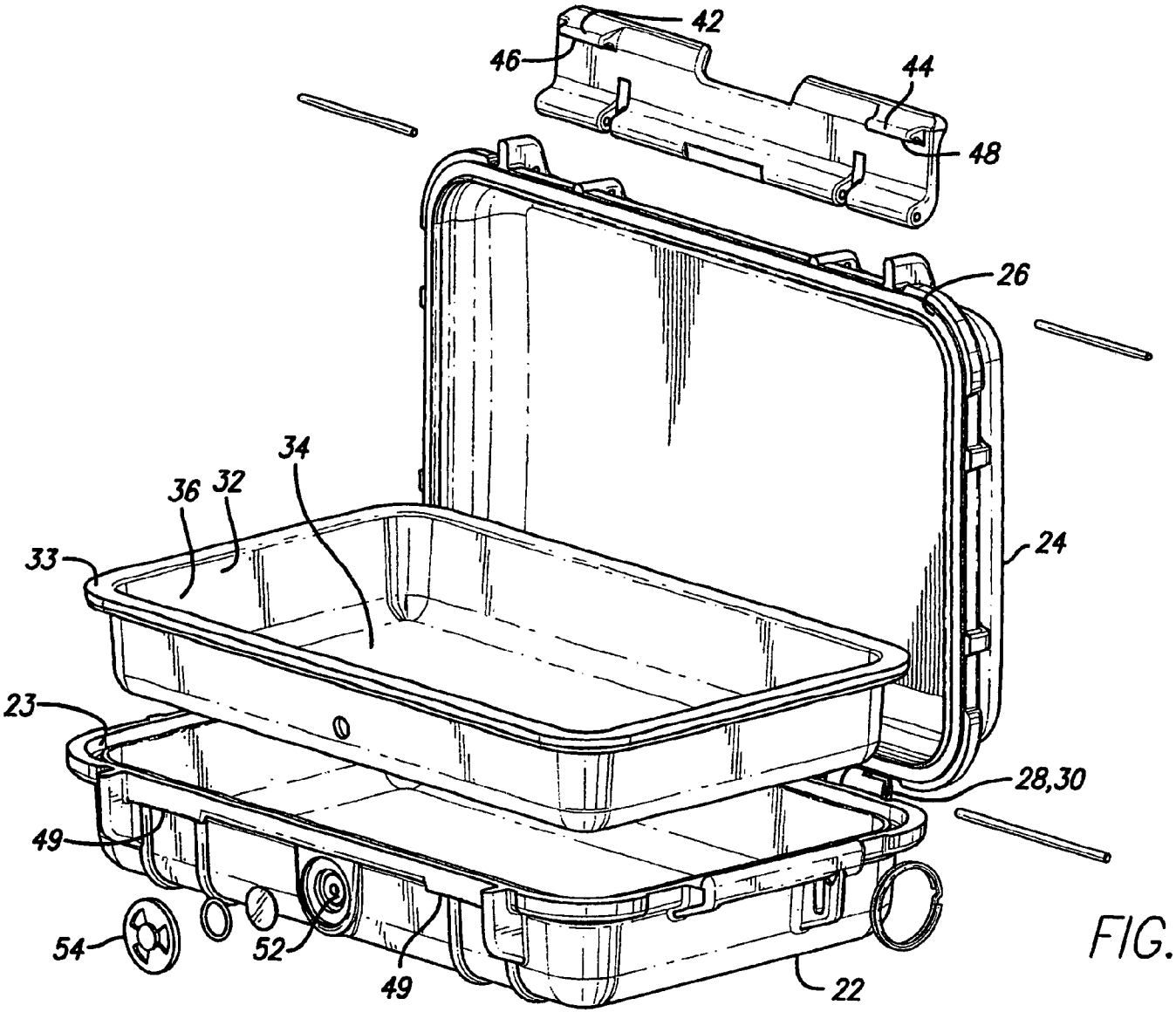
FIG. 2 is an exploded view of the different components of the case showing a liner insert which fits within the case separate from the two components of the case.
Figure 3:
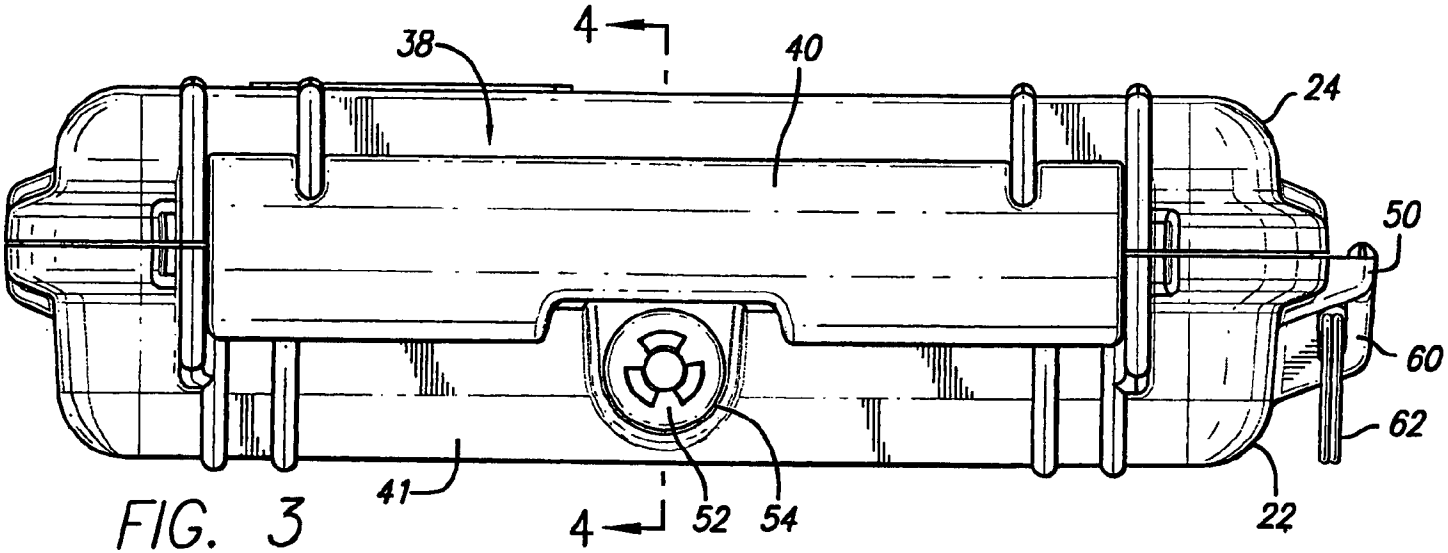
FIG. 3 is a front view of the case.
Figure 5:
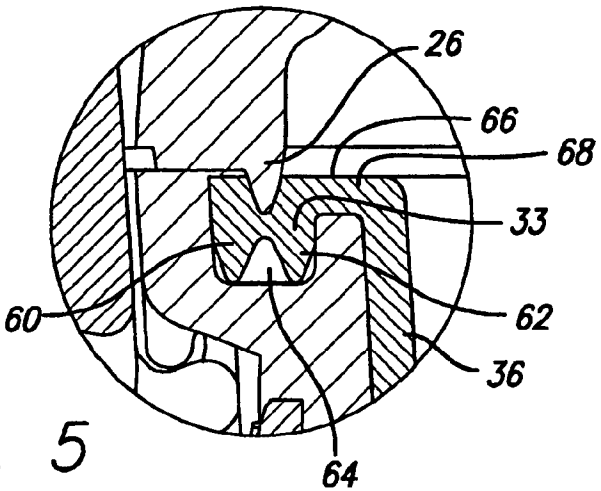
FIG. 5 is an enlarged view of the sealing formations between the top and the bottom portions of the case.
Figure 4:
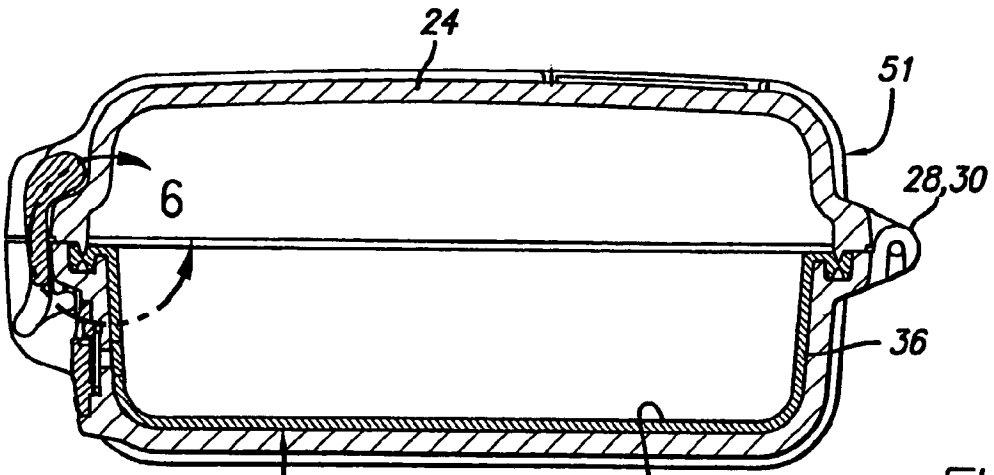
FIG. 4 is a cross-sectional view of the case at the location in the middle of the latch.

In the following description of the preferred embodiments, reference is made to the accompanying drawings which form the part thereof, and in which are shown by way of illustration of specific embodiments in which the invention may be practiced. It is to be understood that other embodiments may be utilized and structural and functional changes may be made without departing from the scope of the present invention.

A carrying case 20 includes two mating components 22 and 24 which form surrounding material for the case. The top component 24 includes a peripheral lip 26 extending around the periphery for mating engagement with a peripheral slot 29 on the bottom component 22 to ensure a relatively closed relationship when the components 22 and 24 are closed. The opening and closure of the components 22 and 24 provide access to a space defined by the surrounding material or closure to the space. The two components 22 and 24 are each made of a relatively rigid polycarbonate plastic material. A pair of hinges 28 and 30 are located along a first side, namely the back side, 51, to permit opening and closure.

A liner material 32 fits in the space in the surrounding material formed by the components 22 and 24. The liner material 32 has a base 34 and an inner peripheral wall 36. The liner material 32 is shaped to conform substantially to the inside of one of the components 22.

There is a peripheral edge 33 around the liner 32 which fits snuggly into the peripheral slot 29.

The peripheral edge 33 has two legs 60 and 62 which are spaced apart so that there is a space 64 between legs 60 and 62. When the lip 26 engages and forces down on the face 66 of the edge 33 there is a deformation which is achieved, and the extra space 64 can thereby become smaller.

This interaction creates an effective sealing interengagement. There is a bringing lateral portion 68 between the edge portion 33 and the walls 36 of the insert 32.

There is a single latch 38 to secure the two compounds 22 and 24 together in a closed relationship. The latch 38 includes a single face member 40 which extends to at least about, and preferably more than half the length of the front 41 of the case. There are a pair of locking members 42 and 44 which are spread apart towards the ends of the face hook like formations 49 on the opposite component 22. This latch structure 38 by extending over a large length of the front of the case is easy to operate both to open or close. The two locking elements 42 and 44 at the end are spaced apart sufficiently to give an effective locking pressure appropriately distributed over the interface of the components on the front of the case.

The latch 38 is located on element 24 and permit hook latching with mating component on element 22. Effectively, the single face 40 for the latch 38 is user friendly and is easier to use than separate latch elements. Only a single motion or step to move the face 40 is necessary to effect the double latching 42-49 and 44-49. Prior art cases require each latch to be activated to closure or disengagement separately.

A handle 50 for pulling or carrying the case is located on one of the components 22 on a side between the back 51 and the front 41. The handle 50 is suitably molded as part of component 22.

A purge valve 52 permits for ingress and egress of pressure to equilibrate the pressure between the inside and the outside of the case. The purge valve in the body permits equilibration of pressure. The valve is "mounted" in one wall of the component 22, and preferably inhibits passage of moisture through the valve, while permitting passage of air. A purge knob 54 is also provided to cooperate with valve 52.

Many modifications and variations are possible in light of the above teaching. For instance instead of the tight sealing arrangement of the components using the liner edge 33, there can instead be an O-ring which is used to conform to the space between the end of the lip 26 and the peripheral slot 29 in a manner to provide sealing between the components. The liner hereby forms a double function, not only as a protective liner, but it also acts as part of the sealing arrangement.

Instead of the liner 32 being molded to fit snuggly with the entire perimeter outer walls of the case, the liner insert 32 may only be in part of one component of the case, namely where the liner 32 is used at the peripheral edge. There could be several separate components making up the liner 32. Also, in some situations, the purge valve may not be used in every embodiment of the case. In other situations there may be only a single latch and a different hinge formation, for instance a piano hinge.

By having a fairly rigid outside component structure to the case, together with a liner removal insert conforming to whole or part of the interior there is provided an effective protective case with a high level of sealing closure to house components. The shape of the interior of the liner can be formed to effectively accommodate different elements to prevent undue movement of the elements to be earned. One or more additional inserts to prevent shock absorbance can be provided inside the liner insert. The outer components can be transparent, translucent, opaque or colored as required. The liner can be similarly formed with different colors and/or transparency or translucency characteristics.

On the side of the case there is also provided means 60 for anchoring a movable ring 62 to permit the case to be carried in a different manner.

The foregoing is a description of the preferred embodiments of the invention and has been presented for the purposes of illustration and description. It is not intended to be exhaustive or to limit the invention to the precise form disclosed.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A carrying case comprising:

a generally rectangular body of surrounding material having a first component and a second component for opening and closing together thereby to provide access to a space defined by the surrounding material, each component having a sealing area for location adjacent a respective sealing area of the opposite component and walls for each of the first and second components;

a hinge mounted exteriorly between the first and second components;

a liner fitting in the space in the surrounding material;

a latch mounted exterior to a top wall and a bottom wall, the top and bottom walls each being one of the walls for the first and second components respectively, the latch having two side ends, a tip, at least one slot parallel to the side ends, and an elongated face component, the elongated face component having an extension to allow a finger of a user to unlock the latch by a lifting action on the extension, the lifting action being an action in an outward direction away from the bottom wall;

a pair of bottom wall extensions extending from the bottom wall, the bottom wall extensions each being located beside a respective side end of the latch such that the latch is located between the bottom wall extensions, each bottom wall extension having an at least one bottommost point, the bottommost point being below the tip of the latch;

a pair of top wall extensions extending from the top wall, the top wall extensions each located beside a respective side end of the latch such that the elongated face component of the latch extends longitudinally from one top wall extension to the other top wall extension;

at least one intermediate support extension extending from the top wall, the at least one intermediate support extension located between the pair of top wall extensions, the intermediate support extension being received in the slot on the latch in both locked and unlocked positions of the latch; and an interlocking element on the latch and a cooperating hook element on the second component for engaging the interlocking element.

2. The carrying case as claimed in claim 1 further including another interlocking element on the latch, such that the pair of interlocking elements are spaced towards the ends of the face component, the cooperating hook element on the second component engaging the pair of interlocking elements.

3. The carrying case as claimed in claim 1 wherein both components are made of translucent or at least partially translucent material, and wherein the liner is opaque.

4. A carrying case as claimed in claim 1 wherein one of the components includes an opening to facilitate purging from the container.

5. A carrying case as claimed in claim 1 wherein the liner fitting in the space in the surrounding material is a single liner.

6. The carrying case as claimed in claim 1 wherein the latch is a centrally located single latch.

7. A carrying case comprising:

a generally rectangular body of surrounding material having a first component and a second component for opening and closing together thereby to provide access to a space defined by the surrounding material, each component having a sealing area for location adjacent a respective sealing area of the opposite component and walls for each of the first and second components;

a hinge mounted exteriorly between the first and second components;

a liner fitting in the space in the surrounding material;

a single latch mounted exterior to a top wall and a bottom wall, the top and bottom walls each being one of the walls for the first and second components respectively, the latch having two ends, at least one slot parallel to the ends and an elongated face component, the elongated face component having an extension to allow a finger of a user to unlock the latch by a lifting action on the extension, the lifting action being an action in an outward direction away from the bottom wall;

a pair of top wall extensions extending from the top wall, the top wall extensions each located beside a respective end of the latch such that the latch is located between the top wall extensions;

at least one intermediate support extension extending from the top wall, the at least one intermediate support extension located between the pair of top wall extensions, the intermediate support extension being received in the slot on the latch in both locked and unlocked positions of the latch; and a pair of interlocking elements on the latch and a cooperating hook element on the second component for engaging the pair of interlocking elements, the pair of interlocking elements being individually spaced towards respective ends of the face component.

8. The carrying case as claimed in claim 7 wherein the liner includes an opening to facilitate purging from the container.

9. The carrying case as claimed in claim 7 wherein both components are made of translucent or at least partially translucent material, and wherein the liner is opaque.

10. A carrying case as claimed in claim 7 wherein one of the components includes an opening to facilitate purging from the container.

11. A carrying case as claimed in claim 7 wherein the liner fitting in the space in the surrounding material is a single liner.

12. The carrying case as claimed in claim 7 wherein the latch is a centrally located single latch.

13. A carrying case comprising:

a generally rectangular body of surrounding material having a first component and a second component for opening and closing together thereby to provide access to a space defined by the surrounding material, each component having a sealing area for location adjacent a respective sealing area of the opposite component and walls for each of the first and second components;

a hinge mounted exteriorly between the first and second components;

a liner fitting in the space in the surrounding material;

a latch mounted exterior to a top wall and a bottom wall, the top and bottom walls each being one of the walls for the first and second components respectively, the latch having two ends and an elongated face component, the elongated face component having an extension to allow a finger of a user to unlock the latch by a lifting action on the extension, the lifting action being an action in an outward direction away from the bottom wall;

a pair of top wall extensions extending from the top wall, the top wall extensions each located beside a respective end of the latch such that the elongated face component of the latch extends longitudinally from one top wall extension to the other top wall extension;

at least one intermediate support extension extending from the top wall, the at least one intermediate support extension having a width and being located between the pair of top wall extensions;

a first length and second length of the latch, the latch being located such that: (a) the first length of the latch is located between one of the top wall extensions and the closest intermediate support extension to the one top wall extension; (b) the second length of the latch is located between the other top wall extension and the closest intermediate support extension to the other top wall extension; the first length and second length both being substantially longer than the width of the at least one intermediate support extension; and an interlocking element on the latch and a cooperating hook element on the second component for engaging the interlocking element.

14. The carrying case as claimed in claim 13 further including a pair of bottom wall extensions extending from the bottom wall, the bottom wall extensions each located beside a respective end of the latch such that the latch is located between the bottom wall extensions.

15. A carrying case comprising:

a generally rectangular body of surrounding material having a first component and a second component for opening and closing together thereby to provide access to a space defined by the surrounding material, each component having a sealing area for location adjacent a respective sealing area of the opposite component and walls for each of the first and second components;

a hinge mounted exteriorly between the first and second components;

a liner fitting in the space in the surrounding material;

a latch mounted exterior to a top wall and a bottom wall, the top and bottom walls each being one of the walls for the first and second components respectively, the latch having two side ends, at least one slot parallel to the ends, and an elongated face component having an outer surface and an inner surface, the elongated face component having an extension to allow a finger of a user to unlock the latch by a lifting action on the extension, the lifting action being an action in an outward direction away from the bottom wall;

a pair of bottom wall extensions extending from the bottom wall, the bottom wall extensions each being located beside a respective end of the latch such that the latch is located between the bottom wall extensions;

a pair of top wall extensions extending from the top wall, the top wall extensions each located beside a respective end of the latch such that the latch is located between the top wall extensions;

wherein the pair of top and bottom wall extensions extend perpendicularly from the respective top and bottom walls at a maximum distance such that the inner surface of the elongated face component does not extend past the maximum distance when the latch is in a locked position;

at least one intermediate support extension extending from the top wall, the at least one intermediate support extension located between the pair of top wall extensions, the intermediate support extension being received in the slot on the latch in both locked and unlocked positions of the latch;

a pin extending in alignment with a traverse opening in the intermediate support extension or at least one of the top wall extensions to support the latch and form a hinge for the latch;

a purge valve on the carrying case for equilibrating pressure between the space in the surrounding material and a space outside the surrounding material when the case is in a closed position; and an interlocking element on the latch and a cooperating hook element on the second component for engaging the interlocking element;

wherein the pair of top wall extensions and the at least one intermediate wall extension all have a substantially similar width.

* * * * *

UNITED STATES PATENT AND TRADEMARK OFFICE

CERTIFICATE OF CORRECTION

PATENT NO. : 7,533,782 B2
APPLICATION NO. : 11/153076
DATED : May 19, 2009
INVENTOR(S) : David H. Parker, John Hoven and Kevin Deighton It is certified that error appears in the above-identified patent and that said Letters Patent is hereby corrected as shown below:

Please replace the first paragraph of the specification beginning at column 1, lines 6-12, with the following paragraph:

This application is a continuation and claims the benefit or the prior filing date of U.S. application Ser. No. 10/719,309, filed Nov. 21, 2003, which is a continuation ~~continuation-in-part~~ and claims the benefit of the prior filing date of U.S. patent application Ser. No. 10/001,652, filed Oct. 31, 2001 now U.S. patent Ser. No. 6,698,608, all herein incorporated by reference in their entireties.

Signed and Sealed this
Twenty-fifth Day of January, 2011

David J. Kappos

David J. Kappos
*Director of the United States Patent and Trademark Office*